US009216886B2

(12) United States Patent
Friedlich

(10) Patent No.: US 9,216,886 B2
(45) Date of Patent: Dec. 22, 2015

(54) REFUELLING STAND

(71) Applicant: Martin Friedlich, Ottawa (CA)

(72) Inventor: Martin Friedlich, Ottawa (CA)

(73) Assignee: Martin Friedlich, Ottawa (CA)

( * ) Notice: Subject to any disclaimer, the term of this patent is extended or adjusted under 35 U.S.C. 154(b) by 0 days.

(21) Appl. No.: 14/288,735

(22) Filed: May 28, 2014

(65) Prior Publication Data

US 2014/0299229 A1 Oct. 9, 2014

Related U.S. Application Data

(63) Continuation of application No. 13/183,860, filed on Jul. 15, 2011, now abandoned.

(51) Int. Cl.

| | |
|---|---|
| ***B65B 39/00*** | (2006.01) |
| ***B67C 11/02*** | (2006.01) |
| ***B67C 11/00*** | (2006.01) |
| ***B67D 7/84*** | (2010.01) |
| ***B67D 7/04*** | (2010.01) |

(52) U.S. Cl.

CPC ..... *B67C 11/02* (2013.01); *B67C 11/00* (2013.01); *B67D 7/04* (2013.01); *B67D 7/845* (2013.01)

(58) Field of Classification Search

USPC ..... 141/18, 297–300, 331–345, 363–366, 141/391

See application file for complete search history.

(56) References Cited

U.S. PATENT DOCUMENTS

| | | | | |
|---|---|---|---|---|
| 1,408,865 | A * | 3/1922 | Cowell | 141/338 |
| 4,245,666 | A * | 1/1981 | Norris | 137/357 |
| 5,720,329 | A * | 2/1998 | Clarke, Jr. | 141/331 |
| 5,878,799 | A * | 3/1999 | Hannick | 141/351 |
| 6,070,769 | A * | 6/2000 | Hornsby | 222/529 |
| 6,109,313 | A * | 8/2000 | Phelps | 141/106 |
| 6,273,155 | B1 * | 8/2001 | Cacho | 141/98 |
| 6,293,505 | B1 * | 9/2001 | Fan | 248/99 |
| 6,845,784 | B2 * | 1/2005 | Pascznk | 137/312 |
| 7,464,735 | B2 * | 12/2008 | Shultz | 141/343 |

* cited by examiner

*Primary Examiner* — Jason K Niesz

(57) ABSTRACT

A refuelling stand that is lightweight and easily portable which includes a funnel; a support for the funnel, which is optionally collapsible, and a conduit which is removably attached to the end of the funnel. The conduit can he made of flexible material which may be rolled up for storage alongside the support or may be formed of inflexible tubing. The refuelling stand may also include at least one stabilizing dement. The refuelling stand is designed to be a free-standing apparatus which is not intended to be permanently or semi-permanently affixed. In addition, the refuelling stand can be entirely disassembled in the form of a kit which further includes instructions for use. The refuelling funnel stand is designed to be suitable for delivering fuel from a hand-held fuel can into the fuel tanks of, for example, watercraft, lawnmowers, snowblowers and the like.

11 Claims, 5 Drawing Sheets

REFUELLING STAND

CROSS REFERENCE TO RELATED APPLICATIONS

This application is a continuation of co-pending U.S. application Ser. No. 13/183,860 filed on Jul. 15, 2011, herein incorporated by reference.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

FIELD OF THE INVENTION

The present invention pertains to the field of fuelling systems and, more particularly, to a refuelling stand with a funnel, a funnel support and a conduit which is removably connected to the funnel. The funnel stand is particularly well suited for refuelling boats and other recreational crafts which are not easily refuelled at traditional gas pumps.

BACKGROUND

Filling up a fuel tank on a small boat, personal watercraft or other watercraft can be difficult, potentially dangerous in rough water, and often results in damaging fuel spills. This is because the watercraft is typically floating and rocking on the water and, for small vessels, the fuel tank opening is usually located at or below the level of the dock where the operator can safely walk and stand. This makes it inconvenient and often quite difficult and potentially dangerous to fill the tank while standing or kneeling on the dock, especially in rough water and high waves caused by boat wakes. When onboard the vessel or next to it on the dock, it is physically demanding on the arms and back to stand and hold a hand-held gas can and try to pour the fuel directly into the tank opening.

The difficulty with easy and quick refuelling of small vessels, such as personal watercraft and small motor boats, is particularly acute on lakes which have no marina to supply a ready source of fuel. Most small lakes scattered throughout North America, which allow motorized crafts, do not have marinas therefore there is no choice but to bring fuel from land based stations. On larger lakes with marinas, taking the watercraft to a marina for fueling can be very time consuming and many marinas experience long lines during peak times, when the boat owners would much prefer to be out on the water rather than traveling to the marina and waiting to fill up the fuel tank. In addition, fuel at land based gas stations is typically less expensive than at marinas. These factors provide strong incentives for filling up the watercraft's fuel tank with gas purchased at a land-based station. Nevertheless, the difficulties experienced with fueling the watercraft from a hand-held fuel can still inhibit many boaters from fueling the watercraft in this manner. In fact, without some type of device to help deliver the fuel from a hand-held fuel can or other suitable container into the fuel tank on the watercraft in a clean and safe manner, many boaters elect to use the marina despite the associated drawbacks. And many small boat and personal watercraft owners who have tried to fill their watercraft with a hand-held fuel can have stories of being swamped, knocked about or even overboard, and spilling fuel while trying to fill the tank.

One product known as the DuraMax® has been developed in an attempt to solve this problem. This particular device includes a fuel holding tank that typically holds about 14 gallons of fuel and includes a hose to deliver the fuel from the holding tank to the watercraft. There are two shut-off valves, at both the tank and hose connector, to disconnect the pump for refilling and transportation. This product, however, is not suitable for many potential users because it is relatively expensive and difficult to use because it is quite heavy for an individual to handle when full and is very slow and time consuming. Because the device is too large to fit into many passenger vehicles and so heavy when full, it generally requires a truck, trailer or some other gear to help transport the device back and forth from the fuel station.

Another product known as the Flo n' go Superflo® also attempts to solve the problem of trying to fill a tank from a hand-held fuel tank. This device is a fuel siphon that pumps gas with an at-the-handle pump control. It has a flow rate of approximately 1 gallon per minute in siphon mode. The Superflo® comprises a siphon/pump and a hose and optionally a fuel can. This product, however, is slow and time consuming when filling the tanks of personal watercraft and small boats.

U.S. Pat. No. 7,464,735 discloses a funnel stand that includes a housing supporting an internal funnel connected to a fuel hose that can be folded or rolled up for storage inside the housing and extended through a hose opening for placement in a fuel tank opening. In addition, the funnel stand may include a lid covering the funnel opening, a door covering the hose opening, and handles to facilitate carrying the device by hand. The funnel stand is designed to be suitable for delivering fuel from a hand-held fuel can into the fuel tanks on small watercraft, such as small boats and personal watercraft.

U.S. Pat. No. 7,048,020 discloses a connector on-board the vehicle, connected to the fuel tank via a pouring conduit and provided with a closure valve, and a filling element adapted to he connected to this connector. The filling element is provided with at least one member for detecting the abutment of the filling element on a fixed part of the connector, this member being adapted to control the displacement of a hook for locking the aforementioned element on the connector, between a first position where the hook is disengaged with respect to the connector and a second position where the hook is in engagement on the connector.

As a result, there is a need for an easier, more convenient and more cost effective way to load fuel onto watercraft while they are in the water. There is a further need for a better way to load fuel purchased at a land-based gas station onto watercraft while they are in the water, particularly while they are floating at a private dock. It would also be beneficial for the device to be universal for many different locations, unobtrusive, attractive, practical, light weight, and generally safe, easy and convenient to use.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a refuelling stand. In accordance with one embodiment of the present invention there is provided a refuelling stand for conveying fuel into a fuel receptacle comprising: a funnel; a conduit for conveying the fuel from the funnel to the fuel receptacle, the conduit being attached to the funnel; a support for the funnel; and at least one stabilizer.

In another preferred embodiment, there is provided the refuelling stand of the preceding paragraph, wherein said support for the funnel is collapsible.

In another preferred embodiment, there is provided the refuelling stand of either of the preceding two paragraphs, further comprising a fastener to removably attach the conduit to the funnel.

In another preferred embodiment, there is provided the refuelling stand of any of the preceding three paragraphs, further comprising wherein said funnel is collapsible.

In another preferred embodiment, there is provided the refuelling stand of any of the preceding four paragraphs, further comprising four stabilizers.

In another preferred embodiment, there is provided the refuelling stand of any of the preceding five paragraphs, further comprising wherein the conduit is a flexible tube.

In another preferred embodiment, there is provided a kit for conveying fuel into a fuel receptacle, the kit comprising a funnel; a conduit for conveying the fuel from the funnel to the fuel receptacle, the conduit being attached to the funnel; a collapsible support for the funnel; and at least one stabilizer for removably attaching the funnel to the support and instructions for assembly.

In another preferred embodiment, there is provided the kit of the preceding paragraph, further comprising a fastener to removably attach the conduit to the funnel.

In another preferred embodiment, there is provided the kit of either of the preceding two paragraphs, further comprising wherein said funnel is collapsible.

In another preferred embodiment, there is provided the kit of any of the preceding three paragraphs, further comprising four stabilizers.

In another preferred embodiment, there is provided the kit of any of the preceding four paragraphs, further comprising wherein the conduit is a flexible tube.

In another preferred embodiment, an adapter for connecting a conduit to an opening of a hand-held fuel can comprising two ends, wherein one end for sealing engagement with the opening of the fuel can and the second end is an extending member which frictionally engages internally with the conduit.

BRIEF DESCRIPTION OF THE DRAWINGS

These and other features of the invention will become more apparent in the following detailed description in which reference is made to the appended drawings.

DETAILED DESCRIPTION OF THE INVENTION

Unless defined otherwise, all technical and scientific terms used herein have the same meaning as commonly understood by one of ordinary skill in the art to which this invention belongs.

The invention will now be described with reference to specific examples. It will be understood that the following examples are intended to describe embodiments of the invention and are not intended to limit the invention in any way.

The present invention involves a refuelling stand that is lightweight and easily portable which includes a funnel; a support for the funnel, which is optionally collapsible, and a conduit which is removably attached to the end of the funnel. The funnel may be anchored to the support with at least one stabilizer.

The refuelling stand of the present invention comprises a support configured to hold the funnel in a secure and convenient position suitable for receiving fuel from a hand held can, or similar source of fuel. The funnel rests on a horizontal support, which is held in place by at least two vertical supports. It is within the scope of the present invention that the horizontal support can have any configuration suitable for holding the funnel in place. The refuelling stand is of minimal construction intended for easy assembly and disassembly. A worker skilled in the art could readily determine the appropriate materials to construct the support of the invention. For example, the support may be constructed out of plastic, wood, composite material, metals or combinations thereof. In one embodiment, the refuelling stand comprises a support of rigid lightweight material consisting of two vertical supports and two horizontal supports which link the two vertical supports to each other. The support may be configured such that the mouth of the funnel may be located above or below the top surface of the vertical supports. In another embodiment of the invention, the support is constructed similar to a stool. In this embodiment, the neck of the funnel would pass through a hole which would be placed in the plane of the seat of the stool. In this embodiment the legs of the stool may optionally be telescoping.

Figure 1:
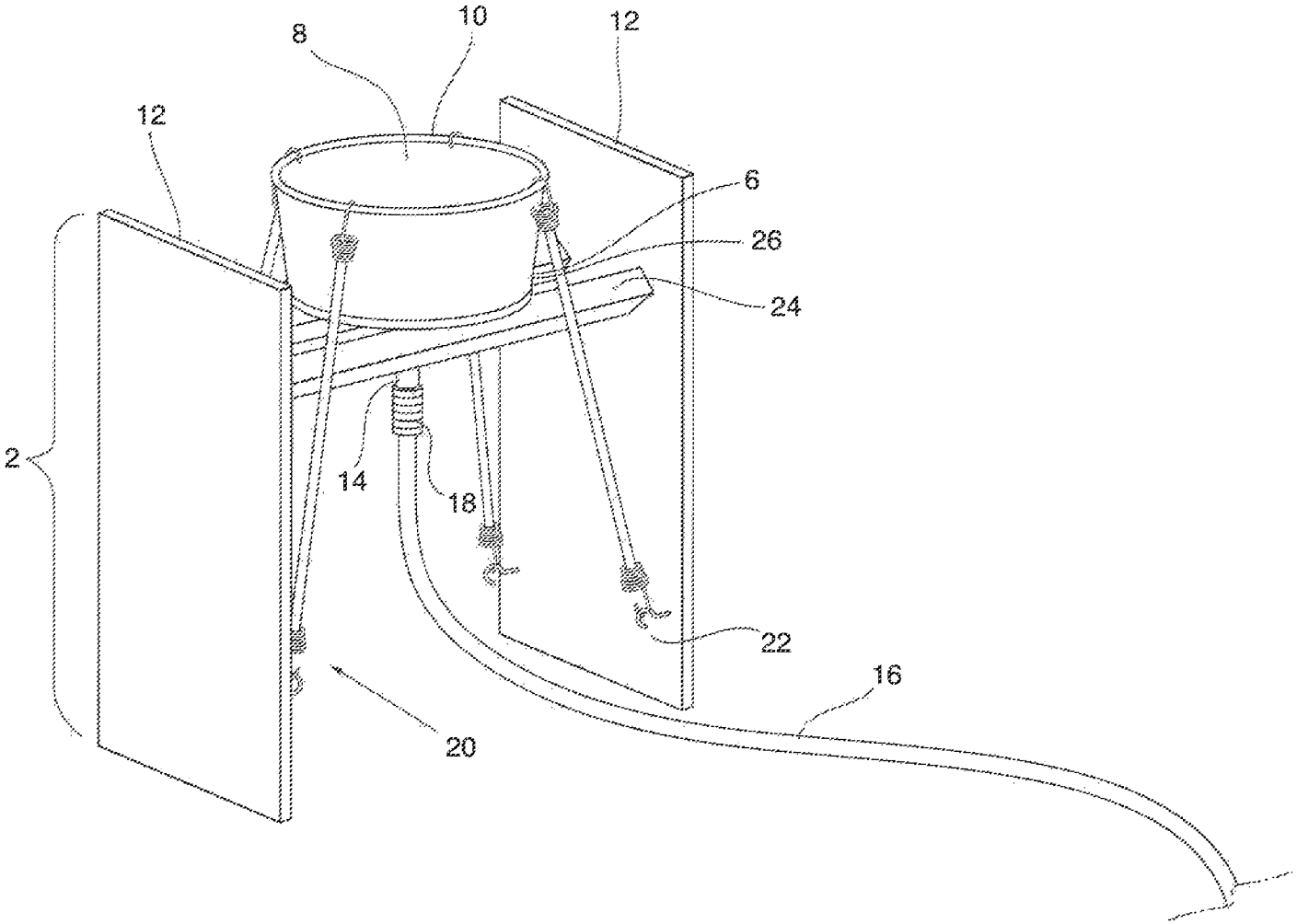
FIG. 1 presents a perspective view of the assembled refuelling stand ready for use in one embodiment of the present invention.

In one embodiment of the present invention, there is provided a refuelling stand as shown in FIG. 1. In this embodiment, the refuelling stand comprises a support (2) of rigid lightweight material consisting of two parallel vertical supports (4) and two parallel horizontal supports (6) which link the two parallel vertical supports to each other. The parallel horizontal supports (6) are configured to support a funnel (8) between the parallel vertical supports (4). In this embodiment of the invention the neck of the funnel (14) is located below the parallel horizontal supports (6) and the conduit (16) is attached therein. In the embodiment of the invention depicted in FIG. 1, there are four stabilizers, each one extending from a respective corner of the inner surface (22) of the two parallel vertical supports (4) to the mouth of the funnel (10). Each stabilizer (20) is attached to the mouth of the funnel (10) by passing along the outer surface (24) of the two parallel horizontal supports.

Figure 2:
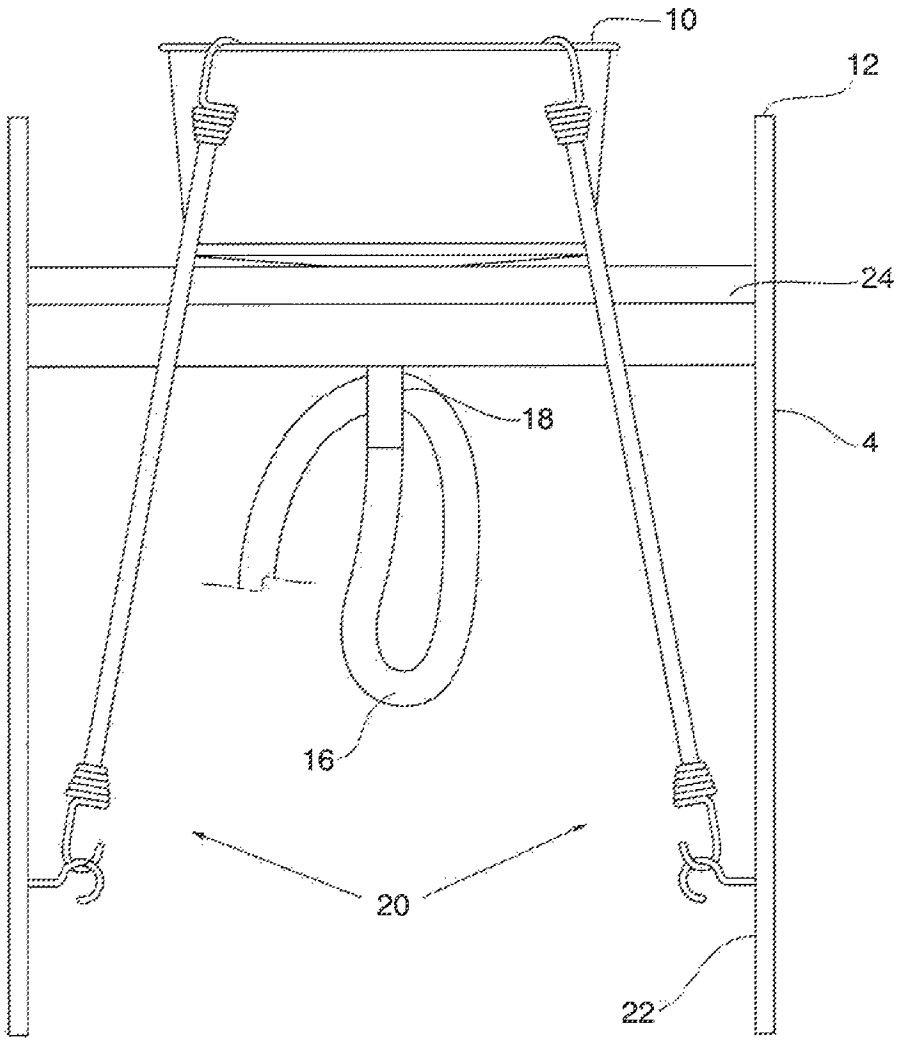
FIG. 2 presents a perspective view of the assembled refuelling stand stored in between uses in one embodiment of the present invention.

In one embodiment, the conduit is made of a material allowing for folding and storage within the two vertical supports. Such an embodiment is illustrated in FIG. 2. By way of example, the conduit could be a hose, plastic tube, rubber, silicone or other suitable means, either flexible or substantially rigid, for transporting fuel from the funnel to the desired receptacle. In one embodiment, the conduit would be of transparent material to ease the end user in judging when a receptacle could receive no additional fuel. The lightweight portable nature of the refuelling stand allows for the easily refuelling of difficult to reach fuel tanks such as water pleasure crafts, personal aircraft, farm equipment and recreational vehicles such as ATVs, snowmobiles and dirt bikes which cannot travel on sanctioned roadways. The conduit may be frictionally attached to the neck of the funnel or be fixedly attached to the neck of the funnel by coupling means. Examples of such coupling means include, but are not limited to, couplers as are known in the art such as clips, cinches or bands.

The invention may further comprise at least one stabilizer which stabilizes the funnel on the support. In one embodiment of the invention, each stabilizer extends from one of the two vertical supports to the mouth of the funnel. In one embodiment of the invention, there are four stabilizers, each one extending from a respective corner of the inner surface of the two parallel vertical supports to the mouth of the funnel. The at least one stabilizer can attach to the mouth of the funnel by passing along the outer surface of the two horizontal supports or may optionally pass between the two horizontal supports along the inner surface. The attachment stabilizers could be hook and link combinations, telescoping attachments, chains, weights or any other stabilizing means known to those of skill in the art.

Figure 3:
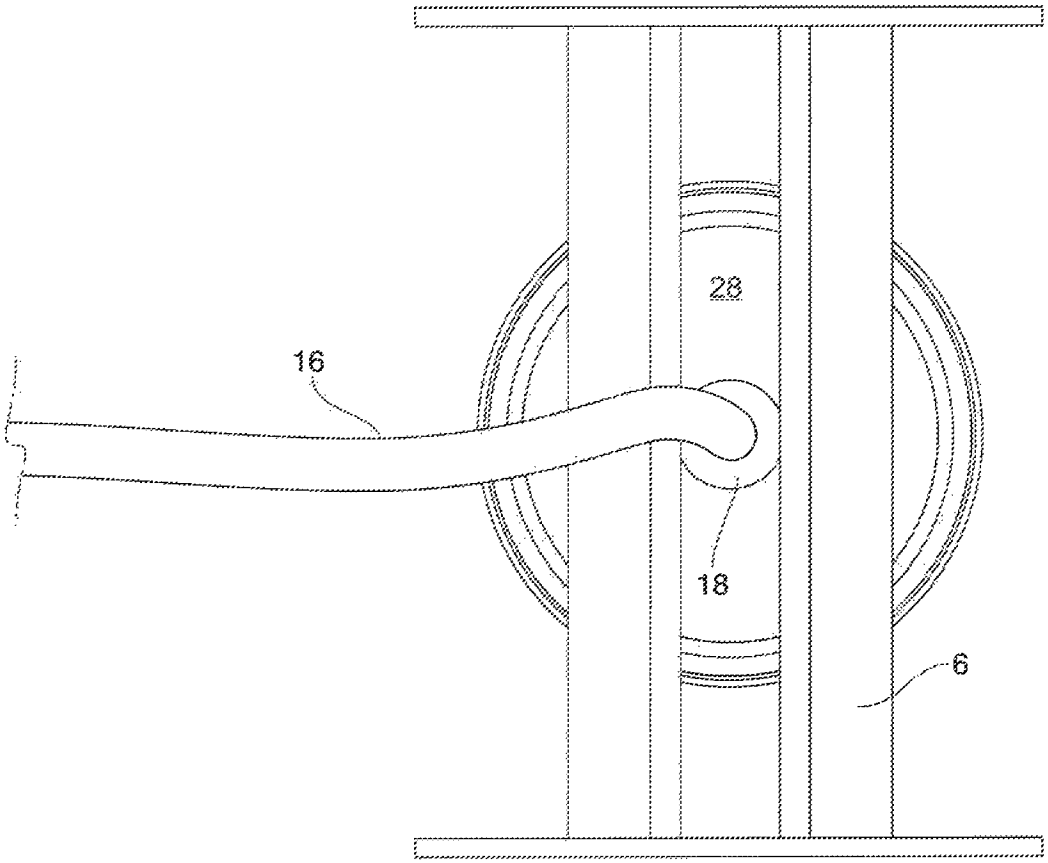
FIG. 3 presents a bottom view of the refuelling stand of the embodiment set forth in FIG. 1.

In another embodiment of the invention the refuelling stand does not require at least one stabilizer. As illustrated in FIG. 3, the distance between the two horizontal supports (6) is wide enough to fully support the base of the funnel (28) without the requirement for stabilizers. In another embodiment of the invention, the two horizontal supports may be angled in a slightly downward fashion to frictionally engage the base of the funnel (28) such that the angled horizontal supports (6) provide a stable retaining of the funnel base (28) thereby preventing the funnel (8) from falling out or coming askew from the support (2). The support retains the funnel (8) within the refuelling stand but the funnel remains easily removable from the support (2) by pulling it up and out from between the two parallel supports (4) or, optionally, removing any stabilizers (20) and removing the funnel.

Figure 4:
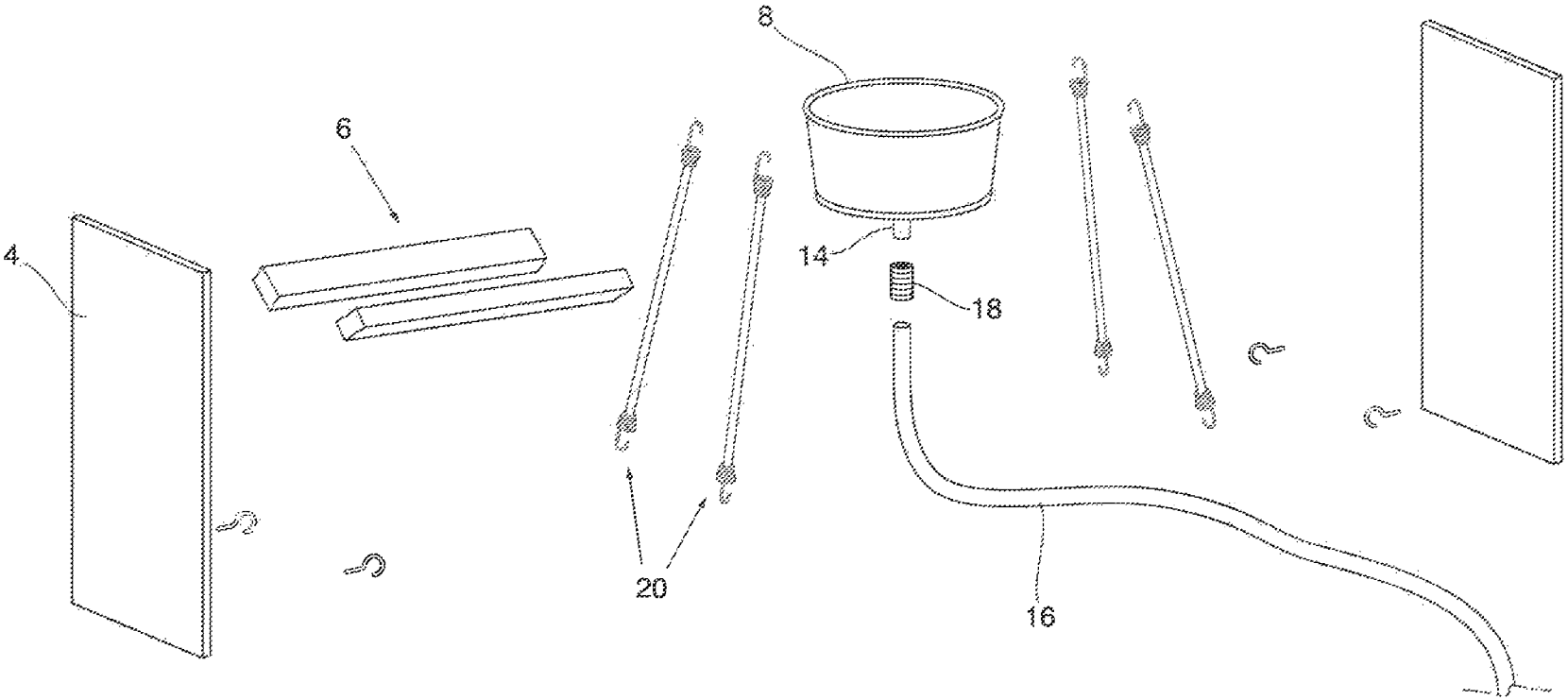
FIG. 4 presents a disassembled view of the refuelling stand prepared for packaging as a kit in one embodiment of the package containing a product.

In another embodiment of the invention the refuelling stand is provided as a kit. As illustrated in FIG. 4, all the presently disclosed elements of the refuelling stand can be readily disassembled and provided as a kit. The funnel in the kit may be collapsible. The kit can further comprise instructions for assembly and optionally, instructions for cleaning and storing the refuelling stand.

Figure 5B:
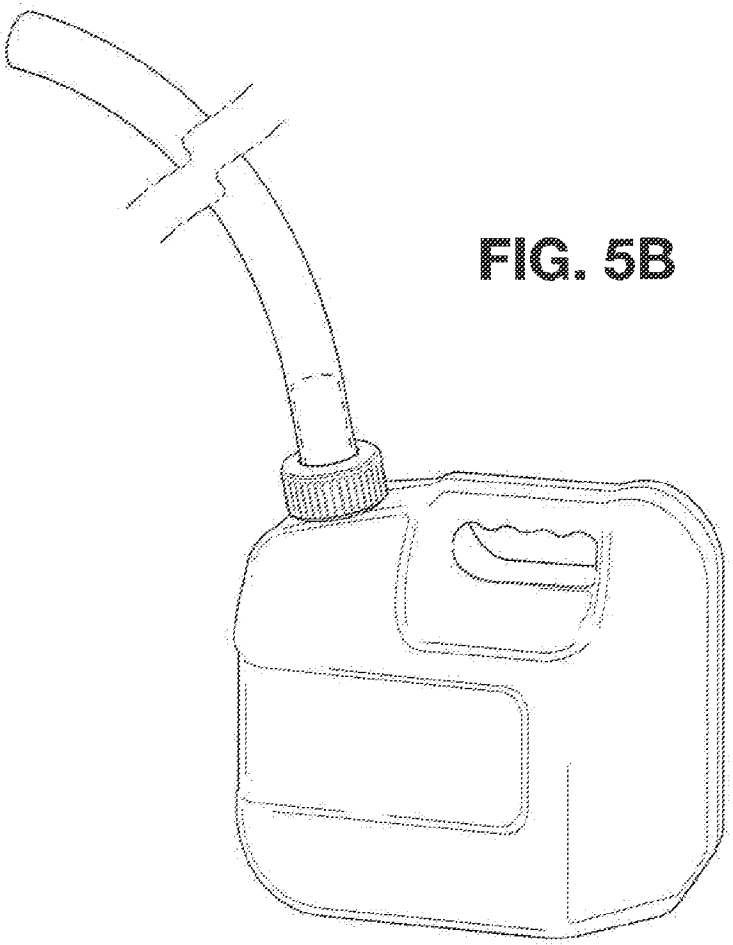
FIG. 5B present an assembled view of the conduit adapter.
Figure 5A:
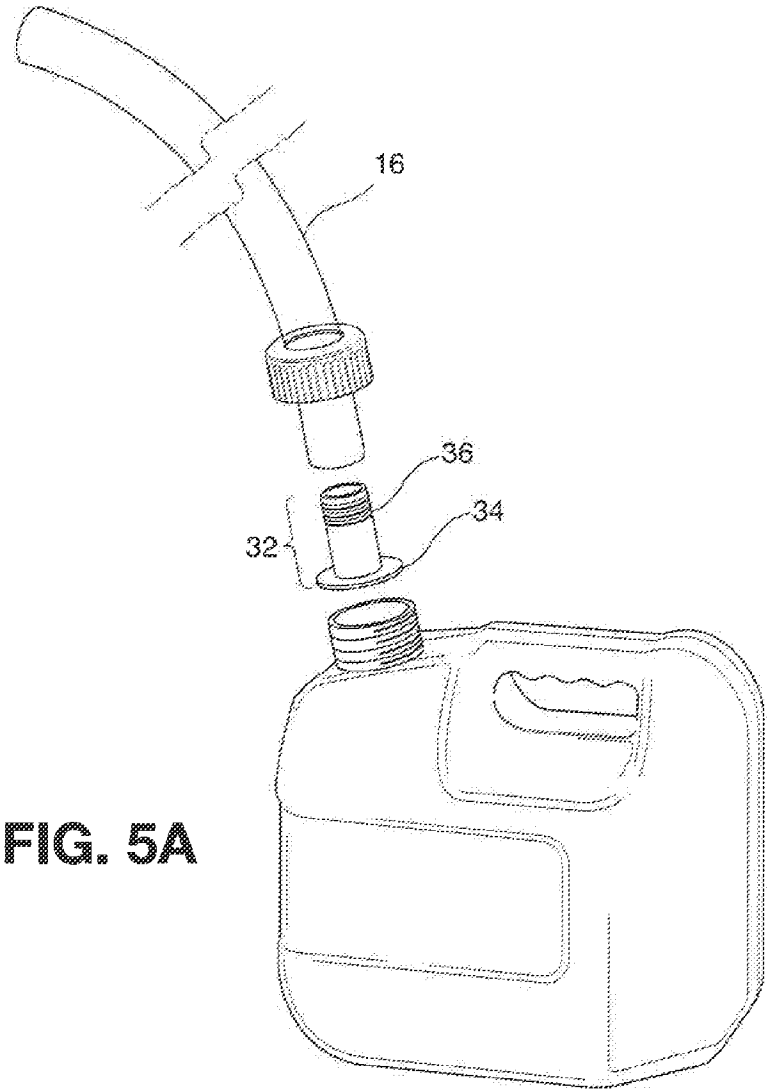
FIG. 5A presents an exploded view of the conduit adapter.

In another embodiment of the invention, as illustrated in FIGS. 5A and 5B, there is provided an adapter (32) for connecting a conduit to an opening of a hand-held fuel can, the adapter having two ends, wherein one end (34) is a flange for sealing engagement with the opening of the fuel can and the second end is an extending member (36) which frictionally engages internally with the conduit (16). In this embodiment of the invention the conduit (16) is attached directly to the hand-held fuel can and the fuel is poured directly into the gas tank. In another embodiment the hand-held fuel can may rest on the support (2). Suitable materials for constructing the adapter would be known to a worker skilled in the art.

In another embodiment of the present invention, there is provided a refuelling stand which further comprises patterns or designs which are associated with the end users recreational activity of choice. It will be readily understood by a worker skilled in the art that such patterns or designs depend on the requirements of the end user of the refuelling stand.

In a further embodiment of the invention the kit packaging can be reused for the storage of the refuelling stand. Preferably, the kit would retain the elements of the refuelling apparatus and maintain them in a secure position for storage for transportation on water pleasure crafts, personal aircraft, farm equipment and recreational vehicles such as ATVs, snowmobiles and dirt bikes.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

A portion of the disclosure of this patent document contains material to which a claim of copyright protection is made. The copyright owner has no objection to the facsimile reproduction by anyone of the patent document or the patent disclosure as it appears in the Patent and Trademark Office patent file or records, but reserves all other rights whatsoever.

Any references cited herein are incorporated herein in their entirety, particularly as they related to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A refuelling stand for conveying fuel into a fuel receptacle comprising:

a funnel;

a conduit for conveying the fuel from the funnel to the fuel receptacle, the conduit being attached to the funnel;

a support for the funnel comprising two vertical supports and at least one horizontal support extending between the two vertical supports, wherein the funnel rests on the at least one horizontal support; and at least one stabilizer.

2. The refuelling stand of claim 1, wherein said support for the funnel is collapsible.

3. The refuelling stand of claim 1, further comprising a fastener to removably attach the conduit to the funnel.

4. The refuelling stand of claim 1, wherein said funnel is collapsible.

5. The refuelling stand of claim 1, comprising four stabilizers extending from the two vertical supports to the funnel.

6. The refuelling stand of claim 1, wherein the conduit is a flexible tube.

7. A kit for conveying fuel into a fuel receptacle, the kit comprising:

a funnel;

a conduit for conveying the fuel from the funnel to the fuel receptacle, the conduit being attached to the funnel;

a collapsible support for the funnel, the collapsible support comprising two vertical supports and at least one horizontal support extending between the two vertical supports, wherein the funnel rests on the at least one horizontal support; and at least one stabilizer for removably attaching the funnel to the support, wherein the at least one stabilizer extends from at least one of the two vertical supports to the funnel; and instructions for assembly.

8. The kit according to claim 7, further comprising a fastener to removably attach the conduit to the funnel.

9. The kit according to claim 7, wherein said funnel is collapsible.

10. The kit according to claim 7, comprising four stabilizers extending from the two vertical supports to the funnel.

11. The kit according to claim 7, wherein the conduit is a flexible tube.

* * * * *